United States Patent [19]

Hutter et al.

[11] 4,365,859

[45] Dec. 28, 1982

[54] COAXIAL TAP CONNECTOR

[75] Inventors: Harold G. Hutter, Brookfield; Leonard J. Francis, Waterbury, both of Conn.

[73] Assignee: Bunker Ramo Corporation, Oak Brook, Ill.

[21] Appl. No.: 180,278

[22] Filed: Aug. 22, 1980

[51] Int. Cl.[3] ..... H01R 11/20; H01R 33/00

[52] U.S. Cl. ..... 339/97 P; 339/177 E

[58] Field of Search ..... 339/97 P, 99 R, 177 E, 339/97 R, 98, 99, 100

[56] References Cited

U.S. PATENT DOCUMENTS

| | | | |
|---|---|---|---|
| 1,373,838 | 4/1921 | Scoppola | 339/97 P |
| 2,986,186 | 7/1959 | Hardmark | 339/100 |
| 3,308,421 | 3/1967 | White | 339/196 R |
| 3,543,222 | 11/1970 | Rheinfelder | 339/99 R |
| 3,611,263 | 10/1971 | Krone | 339/97 R |
| 3,989,400 | 11/1976 | Smith | 339/100 X |
| 4,120,554 | 10/1978 | Bianchi | 339/97 R |
| 4,261,632 | 4/1981 | Narozny | 339/100 X |
| 4,266,842 | 5/1981 | Dillon et al. | 339/97 P |

FOREIGN PATENT DOCUMENTS

| | | |
|---|---|---|
| 717565 | 10/1954 | United Kingdom . |
| 830154 | 3/1960 | United Kingdom . |
| 952647 | 3/1964 | United Kingdom . |
| 989432 | 4/1965 | United Kingdom . |
| 1153129 | 5/1969 | United Kingdom . |

*Primary Examiner*—John McQuade
*Assistant Examiner*—John S. Brown

[57] ABSTRACT

An electrical connector includes a connector body having a U-shaped alignment cavity configured for snugly receiving a coaxial cable and an elongate contact member extending into the cavity from a point disposed along the base thereof, the contact member being adapted for piercing an intact portion of a coaxial cable received within the alignment cavity for making electrical connection with the central conductor of the cable. A pair of additional contact members extend into the alignment cavity and are adapted for piercing intact portions of the coaxial cable for making electrical connection with the conductive braid encircling the central conductor.

6 Claims, 7 Drawing Figures

COAXIAL TAP CONNECTOR

BACKGROUND OF THE INVENTION

The present invention relates generally to electrical connectors and, in particular, to an electrical connector for establishing an electrical tap connection to the inner conductor of an unbroken coaxial cable.

Coaxial cable is commonly used to interconnect a variety of electronic devices largely because of its low loss and high shielding characteristics. For example, many computer systems are frequently interconnected by unbroken lengths of such cables. It often becomes necessary, however, to tap an unbroken length of coaxial cable connected between two electronic devices in order to enable the operation of an additional device in response to the signals transmitted over the cable. Thus, one or more additional terminals or computers may be added to a computer system in this manner.

In the past, unbroken lengths of coaxial cable have been tapped by cutting the cable and installing a tee connector between the cut ends, the central leg of the connector being adapted for mating with a branch cable whose other end is connectable to, in the case of the foregoing example, an additional computer terminal. This operation is relatively time consuming requiring the use of at least semi-skilled personnel and assembly tools. In addition, while the cable is cut and for the period of time that it takes to install the tee connector, the complete computer system may be taken out of service. Also, if at some later time it is desired to remove the installed tee connector, the cut cable must either be spliced together which frequently degrades the signal transmission characteristics of the cable or, alternatively, a new cable must be provided.

U.S. Pat. No. 2,805,399 to Leeper discloses a tee type connector which can be used for tapping a coaxial cable but does not require the cable to be cut during the installation procedure. In a preliminary step to the installation of the connector taught in this patent, a continuous radial opening or channel is formed between the central conductor and exterior surface of a coaxial cable. The connector is then installed by guiding a spring loaded conductor stem into the channel for making electrical connection with the cable central conductor while connection is made with the conductive braid surrounding the central conductor by rotating a tapered screw which penetrates the cable and presses firmly against the conductive braid.

Factors such as thermal variations and other stresses imposed on the coaxial cable comprise a major consideration effecting the design of connectors of the type described above. For example, thermal variations in a cable may cause movement of the contact portions of the connector relative to the cable conductors thereby breaking a previously established electrical connection. In order to minimize the possibility of this occurring, the connector design preferably includes apparatus inhibiting any motion between the contact portions of the connector and the cable conductors, which motion could degrade the electrical connection established therebetween.

It is a basic object of the present invention to provide an improved connector assembly for tapping a coaxial cable, which connector assembly may be easily installed without any installation tools or the like and without requiring the performance of any preliminary cable conditioning steps.

It is a further object of the invention to provide a connector assembly of the foregoing type wherein an extremely secure connection is effected with the cable conductors, both mechanically and electrically, and wherein the connector assembly may be removed from the cable without degrading the cable's signal transmission characteristics.

SUMMARY OF THE INVENTION

In accordance with the foregoing and other related objects, the connector assembly of the invention comprises a connector body adapted for receiving a coaxial cable and maintaining the central conductor thereof in alignment with a protruding cable piercing contact member for making electrical connection with the central conductor. Since the coaxial cable may be seated within the connector body using only finger pressure no preliminary cable conditioning steps nor special tools are needed to effect the installation.

In a preferred embodiment of the invention, the connector body includes a U-shaped alignment cavity configured for snugly receiving the coaxial cable and an elongate contact member extending into the cavity from the lowermost surface thereof, the elongate contact member being adapted for piercing an intact portion of the cable for making electrical connection with the central conductor of the cable. The contact member includes a generally conically shaped cable piercing head which functions as a barb to inhibit withdrawal of the contact member from the central conductor of the cable. Electrical connection is made with the conductive braid encircling the central conductor of the cable by a pair of additional cable piercing contacts extending into the alignment cavity from the lowermost surface thereof and on opposite sides of the central conductor contact member.

BRIEF DESCRIPTION OF THE DRAWINGS

Further objects and advantages of this invention will be apparent from reading the following specification in conjunction with the drawings in which.

DESCRIPTION OF THE PREFERRED EMBODIMENT

Figure 1:
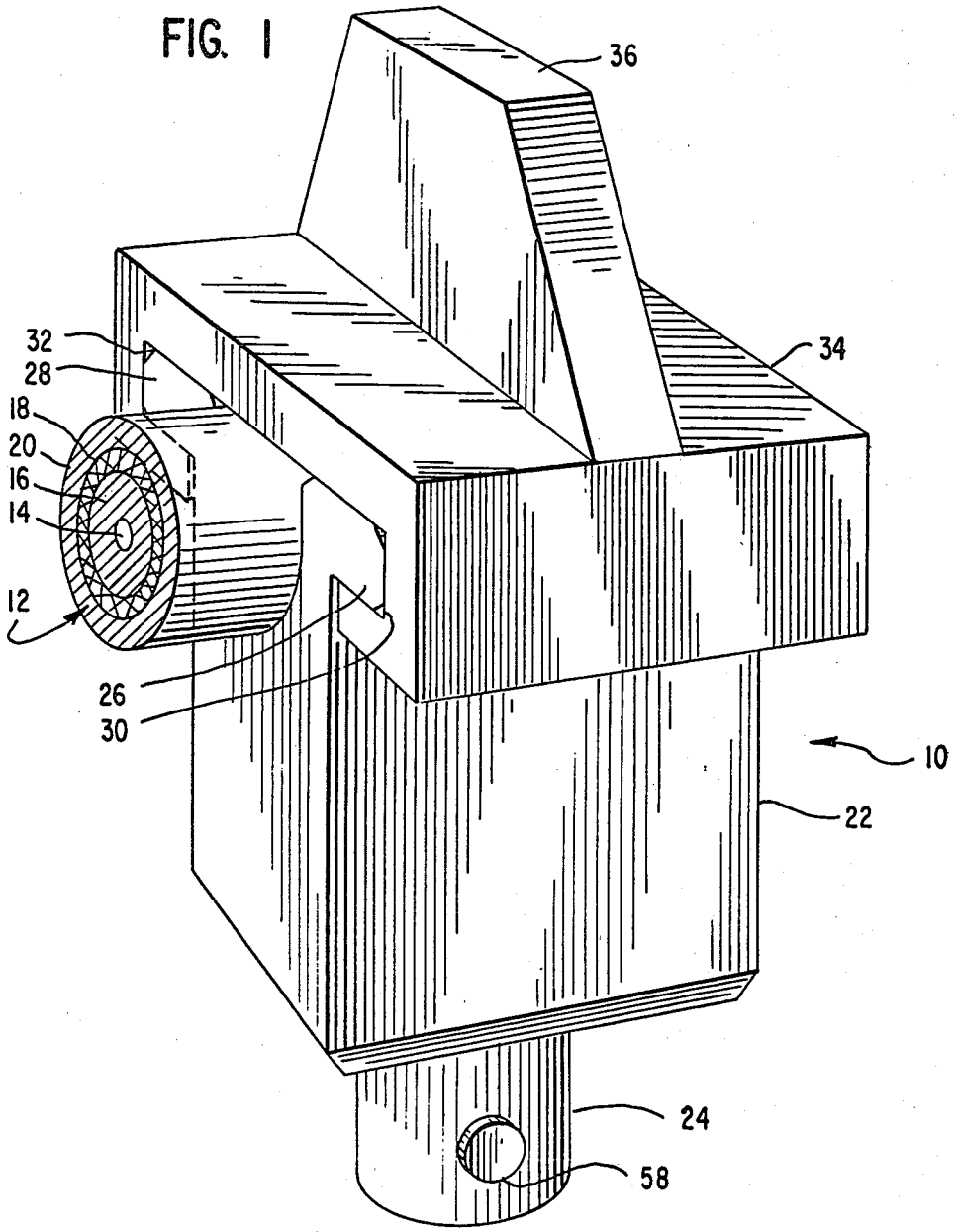
FIG. 1 is a perspective view of the connector assembly of the invention installed on a coaxial cable.

FIG. 1 illustrates an electrical connector 10 constructed in accordance with the present invention, the connector being shown assembled in mating relationship with a coaxial cable 12. Coaxial cable 12 conventionally consists of an inner central conductor 14 surrounded by a dielectric insulating layer 16 which, in turn, is surrounded by an outer conductive shield 18 commonly consisting of a metallic braid. An outer flexible insulating material 20, frequently referred to as a cable jacket, covers the outer conductive shield. Dielectric layer 16 may consist of a variety of materials such as a foam dielectric incorporating a cellular material as is frequently found in coaxial cables used to interconnect computer systems. Connector 10 makes electrical connection with the central conductor and the outer conductive shield of coaxial cable 12 and comprises a connector body 22 which terminates, for example, in a standard female "BNC" jack 24. Connector body 22 also includes a pair of opposed rails 26 and 28 mating in sliding engagement with a pair of corresponding slide tracks 30 and 32 of a connector cover 34. Connector cover 34, which includes a slide handle 36, forms a snug fit with connector body 22 to protect the electrical connection made with cable 12 from external influences. While the connector body is preferably constructed of a metallic material, the connector cover may be formed from a suitable plastic or the like.

Figure 4:
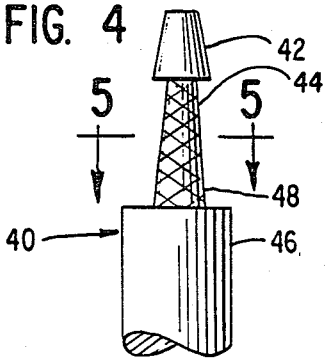
FIG. 4 is an enlarged elevational view showing the central conductor contact of the connector assembly of the invention.
Figure 5:
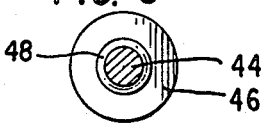
FIG. 5 is a sectional view taken along line 5—5 of FIG. 4.
Figure 2:
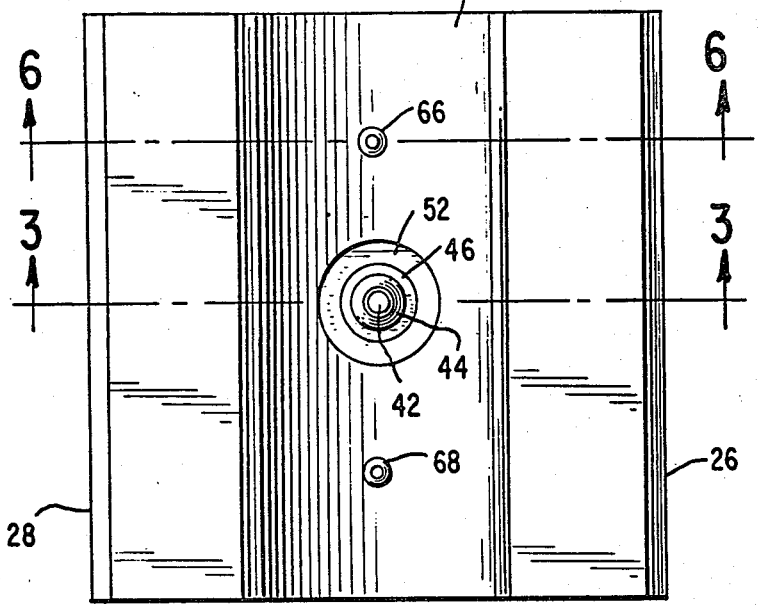
FIG. 2 is a top plan view of the body of the connector assembly shown in FIG. 1.
Figure 3:
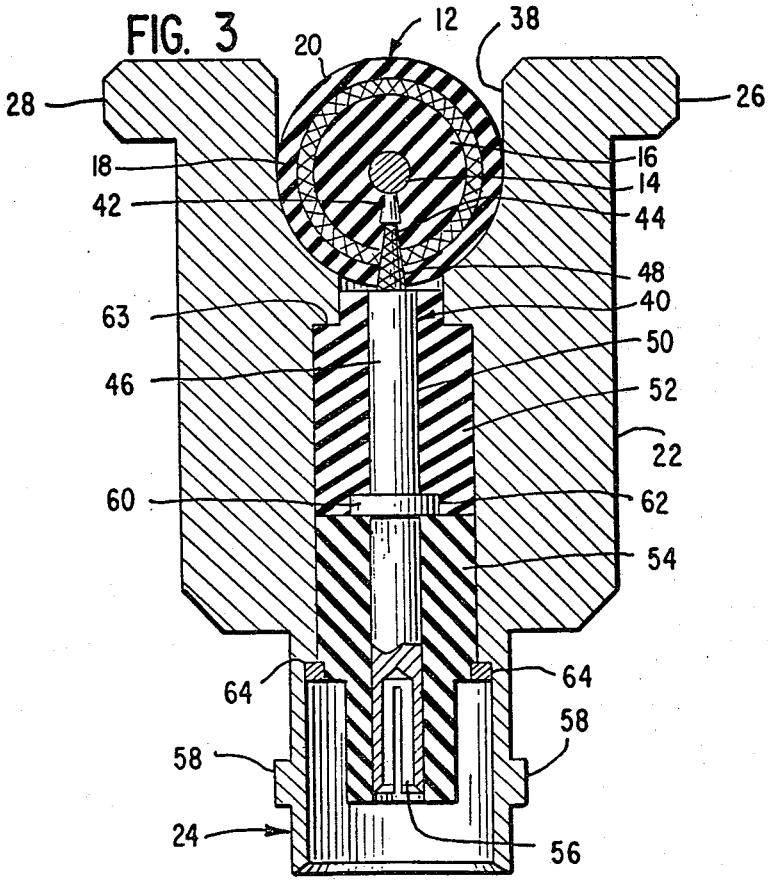
FIG. 3 is a sectional view taken along line 3—3 of FIG. 2.

Referring to FIGS. 2 and 3, connector body 22 has a longitudinally extending, U-shaped alignment cavity 38 configured for snugly receiving coaxial cable 12. Therefore, when cable 12 is seated within the alignment cavity, the longitudinal axis of central conductor 14 is fixed in a central orientation within the cavity and vertically spaced from the lowermost surface thereof. An elongate electrical contact 40 extends centrally through the connector and upwardly into alignment cavity 38. As shown in detail in FIGS. 4 and 5, contact 40 comprises a generally conically shaped cable piercing head 42 at the end of a tapered contact portion 44 which extends into alignment cavity 38 from an inner contact portion 46. Due to the positional relationship of contact 40 relative to alignment cavity 38 of connector body 22, the seating of coaxial cable 12 within the alignment cavity will result in contact 40 piercing cable jacket 20, outer conductor 18, dielectric layer 16 and making electrical connection with central conductor 14 of the cable. Moreover, due to the construction and dimensions of contact 40, the smallest transverse dimension of cable piercing head 42 preferably being on the order of 0.008 to 0.010 inches, only downward finger pressure on cable 12 is required to enable contact 40 to penetrate the cable. In addition, as a result of the cold flowing of dielectric layer 16 around contact 40, cable piercing head 42 acts as a barb for inhibiting the contact from backing away or being withdrawn from the central conductor 14 when, for example, cable 12 is subjected to thermal changes. Also, as shown in FIGS. 4 and 5, tapered contact portion 44 of contact 40 includes an insulating jacket 48 which may comprise an epoxy coating or other suitable insulation material for preventing the formation of an electrical connection between the contact and outer conductor 18 of coaxial cable 12.

As shown in detail in FIG. 3, inner contact portion 46 of contact 40 extends through and is captivated within a bore 50 formed in a front dielectric insert 52 and an abutting rear dielectric insert 54. The dielectric inserts, preferably comprising a copolymer of styrene, isolate the inner contact portion from metallic connector body 22. The inner contact portion of contact 40 terminates in a conventional female contact 56 of BNC jack 24 which also includes a pair of conventional bayonet pins 58 to facilitate mating with a complementary BNC plug (not shown). An annular flange 60 of the contact is retained within a corresponding recess 62 formed in front dielectric insert 52 to inhibit sliding movement of the contact within bore 50 especially when a male contact (not shown) is joined with or removed from female jack 24. An annular shoulder 63 in the connector body engages a reduced diameter portion of front dielectric insert 52 and a retaining ring 64 encircles the rear dielectric insert 54 to captivate the dielectric inserts in the connector body.

Figure 6:
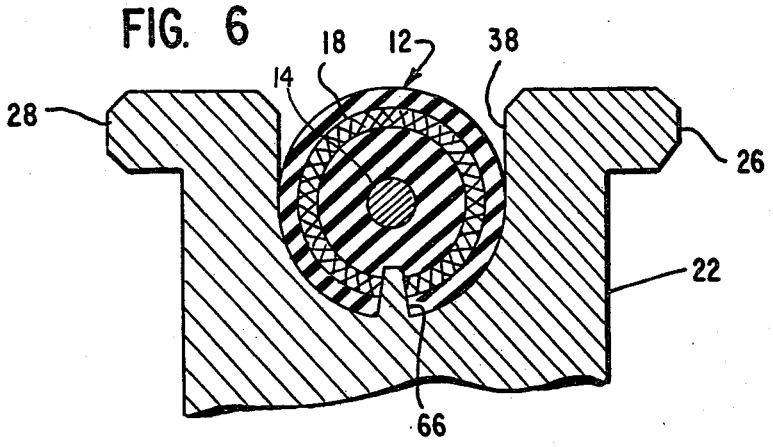
FIG. 6 is a sectional view taken along line 6—6 of FIG. 2.

Referring to FIGS. 2 and 6, a pair of pin-like contact members 66 and 68, each forming an integral part of connector body 22, also extend upwardly into alignment cavity 38 to make electrical connection with outer conductor 18 of cable 12. Contact members 66 and 68, which are disposed in longitudinal alignment with and on opposite sides of contact 40 along the lowermost surface or base of alignment cavity 38, are also adapted for piercing, under finger pressure, a coaxial cable seated within the cavity. These contact members are, however, somewhat shorter than contact 40 such that the two contacts penetrate cable jacket 20 and outer conductor 18 but only slightly into dielectric layer 16. In this manner, contact members 66 and 68, and thereby metallic connector body 22, make electrical connection only with outer conductor 18, this electrical connection being communicated by the connector body to BNC jack 24.

Figure 7:
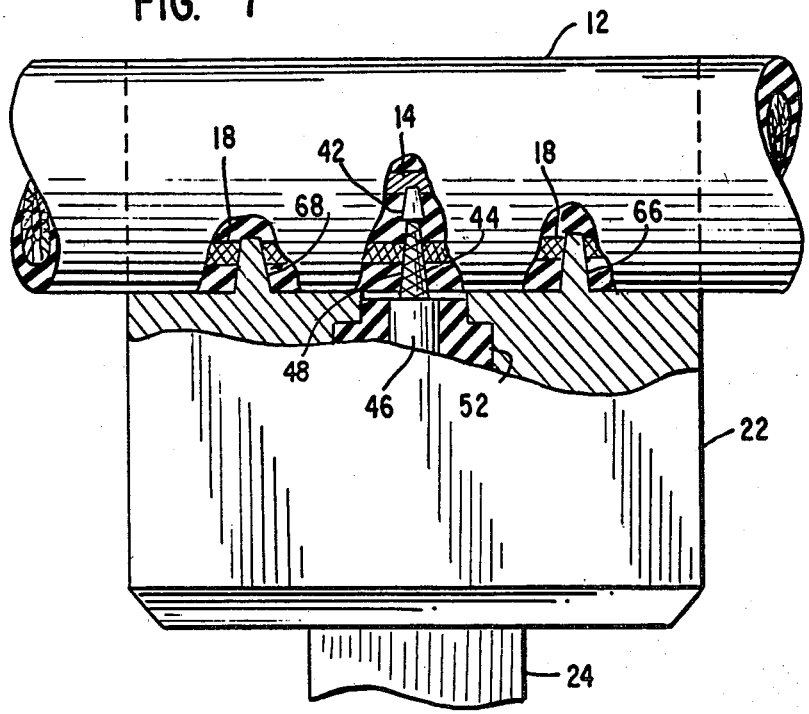
FIG. 7 is a partially broken elevational view showing the contacts of the connector assembly of the invention making electrical connection with a coaxial cable.

In order to install connector 10 to an intact or unbroken portion of coaxial cable, i.e. a portion of cable which has not been subjected to any preliminary conditioning steps, the coaxial cable is placed within U-shaped alignment cavity 38 and firmly pressed down into the cavity using only finger pressure. As a result, the upstanding tapered contact portion 44 of contact 40, inlcuding cable piercing head 42, pierces cable 12 and makes electrical connection with the central conductor 14 while contact members 66 and 68 pierce the cable and make electrical connection with outer conductor 18. The complete electrical connection of connector 10 and coaxial cable 12 is best illustrated in FIG. 7. As mentioned previously, the barb-like configuration of cable piercing head 42 facilitates penetration into the cable and inhibits the contact from backing away from the central conductor of the cable while the insulative jacket 48 prevents a short circuit between contact 40 and outer conductor 18. In addition to making electrical connection with outer conductor 18 of cable 12, contact members 66 and 68 also tend to inhibit unwanted lateral movement between coaxial cable 12 and connector body 22. As described above, the electrical connection made by contact members 66 and 68 to the outer conductor of cable 12 is communicated to jack 24 through metallic connector body 22 while the electrical connection of contact 40 to central conductor 14 is communicated to female contact 56 through inner contact portion 46 of contact 40.

After electrical connection has been made to the coaxial cable, as described above, connector cover 34 is positioned such that slide tracks 30 and 32 are in alignment with rails 26 and 28 of the connector body. The cover is then slid in place as shown in FIG. 1 to capture, slightly compress cable 12 within alignment cavity 38, and maintain the electric connection. This completes the assembly of the connector to the cable and enables electrical signals to be transmitted from cable 12 to a branch cable when a mating BNC plug engages jack 24. Should subsequent removal of the connector 10 become necessary, connector cover 34 is simply removed from connector body 22 and cable 12 is lifted from the alignment cavity. The signal transmission characteristics of the coaxial cable are not noticeably degraded by this removal operation since only three small pinholes remain in the cable removal area. Also, the barb-like configuration of cable piercing head 42 does not significantly obstruct the removal operation.

It will thus be appreciated that the connector of the present invention may be installed on a coaxial cable without any preliminary cable conditioning operations, such as cutting or the like, and without the use of any special installation tools, crimping or soldering. System down time is thereby completely eliminated when installing the connector. In addition, due to the barb-like configuration of the cable piercing head of contact 40, and due to the fact that the cable is captured and alightly compressed within the U-shaped alignment cavity, a highly reliable connection, both mechanically and electrically, is achieved.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. A simple low-cost coaxial cable tap adapted for tooless installation upon a coaxial cable in the field without interrupting the cable comprising:

a housing forming a U-shaped support channel for receiving and aligning an intact section of a coaxial cable, said housing including a coaxial connector element affixed thereto for detachable engagement with a mating coaxial connector element;

contact means in the bottom of said channel for piercing and making an electrical contact solely with the outer conductive shield of said coaxial cable when said coaxial shield is pressed into said channel;

an elongate contact mounted in said housing and extending radially into said U-shaped channel for piercing said cable and making electrical connection with the central conductor thereof when said cable is pressed into said channel, said elongate contact including an insulated stem for preventing electrical connection with said shield, and a barbed head for minimizing movement of said center connection once made; and cover means for said housing for closing said U-shaped channel and for maintaining said cable slightly compressed therein.

2. A coaxial cable tap as set forth in claim 1 wherein said insulated stem is formed by an epoxy paint on the elongate contact.

3. A coaxial cable tap as set forth in claim 2 wherein said housing is constructed of a one-piece die-cast metal.

4. A coaxial cable tap as set forth in claim 3 wherein said housing and said cover means are joined together by a sliding motion.

5. A simple, low-cost coaxial cable tap adapted for toolless installation upon a coaxial cable in the field without interrupting the cable comprising:

a one-piece die cast metal conductive housing forming a U-shaped support channel for receiving and aligning an intact section of said coaxial cable and including a coaxial connector element affixed thereto for detachable engagement with a mating coaxial connector element;

contact means in the bottom of said channel for piercing and making electrical connection solely with the outer conductive shield of said coaxial cable when said cable is pressed into said channel;

an elongate contact mounted in the housing and extending radially into said U-shaped channel for piercing said cable and making electrical connection with the central conductor thereof when said cable is pressed into said channel, said elongate contact including an epoxy coated insulated stem for preventing electrical connection with said shield, and a barbed head for minimizing movement of said center connection once made;

said elongate contact and said contact means being dimensionally small to facilitate piercing of said cable by the use of only finger pressure between said cable and said housing; and cover means for said housing for slidingly closing said U-shaped channel and maintaining said cable slightly compressed therein.

6. A simple low cost coaxial cable tap adapted for toolless installation in the field upon a predetermined length of cylindrical coaxial cable having a predetermined outer diameter without interrupting any existing signal transmission within and along the cable, said cable having a central conductor, a dielectric layer surrounding said conductor, a flexible conductive shield surrounding said dielectric layer and an outer jacket covering said shield, the outer surface of said jacket defining said predetermined outer diameter of said cable, said tap comprising:

a body portion and a cover portion, said body portion being comprised of an electrically conductive material and having at least a first and a second outer surface portions;

said first surface portion having a substantially U-shaped alignment cavity therein running along the length of said first surface portion for a distance substantially equal to said predetermined length of said coaxial cable upon which the tap is to be installed, said alignment cavity being open at each of its end extremities with the depth of said cavity being substantially equal to but less than said predetermined cable outer diameter and with the width of said cavity, at a position immediately adjacent the surface of said first surface portion, being substantially equal to but greater than said predetermined cable outer diameter such that said cable may be received by said cavity and when fully seated therein become supported by the lowermost surface of said cavity with the uppermost outer surface of said cable extending only relatively slightly above the surface of said surface portion;

first electrical contact means electrically integral with said first body portion extending upwardly from within said cavity, the uppermost end extremity of said contact means being spaced from the lowermost surface of said cavity by a distance enabling said end extremity to extend through the outer jacket of said coaxial cable without contacting said cable central conductor and establish electrical contact with the fliexible conductive shield of said cable when said cable is fully seated in said cavity;

second electrical contact means comprising an elongate contact member supported by electrically insulative material within a bore in said body portion, said bore opening into and extending from the lowermost portion of said cavity to a position on and through said second outer surface portion of said body portion, the uppermost end extremity of said contact member being spaced from the lowermost surface of said cavity by a distance enabling said end extremity thereof to extend through the outer jacket, the flexible conductive shield, and the dielectric layer of said coaxial cable to establish electrical contact with said central conductor, the portion of said contact member adjacent said flexible shield being electrically insulated from said shield by a nonconductive material when said cable is fully seated in said cavity;

the other end extremity of said contact member being electrically connected at a position close to said second outer surface portion to a circular coaxial connector element extending away from said second surface for detachable engagement with a mating coaxial connector element;

the surface areas of the uppermost extremities of said first contact means and said contact member of said second contact means being sufficiently small as to enable the upper extremities thereof to penetrate the outer jacket, flexible conductive shield, and dielectric layer of said cable when the cable is pressed by the fingers of the human hand into full seated engagement with the lowermost surface of said cavity;

and means for manually fixing said cover porion to said body portion into closing relationship to said U-shaped cavity to impose a slight compressional force to the coaxial cable after having been pressed into seated engagement with the lowermost surface of said cavity.

* * * * *